US012729560B2

(12) United States Patent
Schneider et al.

(10) Patent No.: US 12,729,560 B2
(45) Date of Patent: Sep. 8, 2026

(54) MIXED MATERIAL HORIZONTAL ALUMINUM FENCE SYSTEM AND METHOD

(71) Applicant: Barrette Outdoor Living, Inc., Middleburg Heights, OH (US)

(72) Inventors: Christopher Michael Schneider, Linwood, NJ (US); Paige Barbara Moore, Absecon, NJ (US); Patrick Joseph Bertke, Mays Landing, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 199 days.

(21) Appl. No.: 18/497,347

(22) Filed: Oct. 30, 2023

(65) Prior Publication Data

US 2024/0141686 A1 May 2, 2024

Related U.S. Application Data

(60) Provisional application No. 63/420,359, filed on Oct. 28, 2022.

(51) Int. Cl.
*E04H 17/16* (2006.01)
*E04H 17/20* (2006.01)

(52) U.S. Cl.
CPC ..... *E04H 17/168* (2013.01); *E04H 17/21* (2021.01)

(58) Field of Classification Search
CPC . E04H 17/14; E04H 17/1447; E04H 17/1452; E04H 17/1456; E04H 17/1488; E04H 17/16; E04H 17/168; E04H 17/17; E04H 17/1413; E04H 17/1465; E04H 17/1469
See application file for complete search history.

(56) References Cited

U.S. PATENT DOCUMENTS 4,007,919 A * 2/1977 Totten ..... E04H 17/1413 256/65.13
4,047,703 A * 9/1977 Murdock ..... E04H 17/1413 403/244

(Continued)

FOREIGN PATENT DOCUMENTS

CA 2198511 A1 * 8/1998 ..... E04H 17/006
CA 2806405 A1 * 8/2013 ..... E04H 17/168

(Continued)

OTHER PUBLICATIONS

Canadian Office Action mailed Feb. 24, 2025 issued in connection with corresponding Canadian Patent Application No. 3,217,949 (5 pages total).

(Continued)

*Primary Examiner* — Jonathan P Masinick
(74) *Attorney, Agent, or Firm* — John Maldjian, Esq.; Stevens & Lee PC

(57) ABSTRACT

A system includes a post configured at an initial position. The system also includes a plurality of ribs within an inner channel of the post. A front set of ribs are positioned at a front portion of the inner channel. A back set of ribs are positioned at a back portion of the inner channel. The back set of ribs are configured to receive a different set of boards than the front set of ribs. In the system, the set of boards are positioned within the back set of ribs within the inner channel of the post.

20 Claims, 7 Drawing Sheets

(56) References Cited

U.S. PATENT DOCUMENTS

| | | | | |
|---|---|---|---|---|
| 7,690,629 | B1 * | 4/2010 | Briggs | E04H 17/168 256/65.12 |
| 8,511,648 | B2 * | 8/2013 | McCarthy | E04H 17/1404 256/65.01 |
| 10,253,524 | B2 * | 4/2019 | Schneider | E04H 17/1488 |
| 10,301,842 | B2 * | 5/2019 | Volin | E04H 17/1417 |
| 10,718,133 | B1 * | 7/2020 | Maher | E04H 17/165 |
| 10,975,592 | B2 * | 4/2021 | Smith | E01F 15/0484 |
| 11,746,559 | B2 | 9/2023 | Amsellem | |
| 11,891,832 | B2 * | 2/2024 | Schneider | E04H 17/1456 |
| 12,480,328 | B2 | 11/2025 | Schneider et al. | |
| 2003/0213947 | A1 * | 11/2003 | Takagi | E04H 17/1413 256/65.02 |
| 2006/0113517 | A1 * | 6/2006 | Colantonio | E04H 17/168 256/24 |
| 2007/0158628 | A1 * | 7/2007 | Tsao | E04H 17/1465 256/19 |
| 2013/0092473 | A1 * | 4/2013 | Humphries | E04H 17/168 181/285 |
| 2017/0058557 | A1 * | 3/2017 | Wu | E04H 17/22 |
| 2017/0211272 | A1 * | 7/2017 | Cullinan | E04H 17/1413 |
| 2023/0212875 | A1 * | 7/2023 | Walker | E04H 17/168 256/24 |
| 2024/0141682 | A1 * | 5/2024 | Heritage | E04H 17/1452 |
| 2024/0141683 | A1 * | 5/2024 | Schneider | E04H 17/1465 |
| 2024/0141685 | A1 * | 5/2024 | Schneider | E04H 17/1447 |
| 2024/0141686 | A1 * | 5/2024 | Schneider | E04H 17/168 |
| 2025/0092714 | A1 * | 3/2025 | Lo | E04H 17/1447 |
| 2025/0172012 | A1 * | 5/2025 | Fitzgerald | E04H 17/1488 |

FOREIGN PATENT DOCUMENTS

| | | | | | |
|---|---|---|---|---|---|
| CA | 3121081 | A1 | | 12/2021 | |
| CN | 110331682 | A | | 10/2019 | |
| DE | 10146517 | C1 | * | 3/2003 | E04H 17/168 |
| DE | 102012100567 | A1 | * | 5/2013 | E01F 8/0011 |
| DE | 202012103687 | U1 | * | 11/2013 | E04H 17/1413 |
| DE | 202014000716 | U1 | * | 2/2014 | E04H 17/20 |
| DE | 202013011807 | U1 | * | 9/2014 | D04H 11/00 |
| DE | 102020100493 | A1 | * | 7/2021 | E06B 11/02 |
| EP | 2884004 | A2 | * | 6/2015 | E04H 17/20 |
| EP | 3399123 | A1 | * | 11/2018 | E04H 17/168 |
| FR | 3032003 | B1 | * | 1/2017 | |
| FR | 3041014 | B3 | * | 10/2017 | |
| FR | 3041013 | B1 | * | 5/2018 | E04H 17/22 |
| GB | 1536546 | A | * | 12/1978 | E04H 17/20 |
| GB | 2352740 | A | * | 2/2001 | E04H 17/168 |
| JP | 11172643 | A | * | 6/1999 | |
| KR | 102024717 | B1 | * | 9/2019 | E04H 17/1413 |
| KR | 102610183 | B1 | * | 12/2023 | E04H 17/1448 |

OTHER PUBLICATIONS

Canadian Office action mailed Jun. 19, 2026, issued in connection with corresponding Canadian patent application No. 3,217,884 (6 pages total).

* cited by examiner

MIXED MATERIAL HORIZONTAL ALUMINUM FENCE SYSTEM AND METHOD

CROSS-REFERENCE TO RELATED APPLICATION

This application claims benefit and priority to U.S. Provisional Application Ser. No. 63/420,359, filed Oct. 28, 2022, entitled "MIXED MATERIAL HORIZONTAL ALUMINUM FENCE SYSTEM AND METHOD" which is incorporated herein by reference in its entirety.

FIELD OF INVENTION

The present disclosure generally relates an end post capable of being connect to boards of a different material than the top rail, bottom rail, and end posts within a fence system.

BACKGROUND

Fence structures will often not have the aesthetic enhancement that is often desired. Further, fence structures may often also not have the structural enhancement desired as well. Further, when an aesthetic appeal is added to the fence structure, often times the structural support can be compromised.

In addition, fence structures can typically have materials made of the same material or substantially similar material. The posts of the fence structure and also the boards of the fence structure will often be made of substantially similar materials. As such, users or owners of such fence systems may have a fence system that lacks aesthetic appeal.

Another issue is that fence owners may not know how to make it structurally possible within the fence structure to receive different types of board materials. The end posts within the fence system may not be able to receive boards of different materials. As a result, the fence system can be thereby limited to only receiving boards of a same material as the end posts and other parts of the fence structure.

Accordingly, to enable the fence structure to have mixed materials within, a structural enhancement within the fence system is required. In other words, some portion of the fence system has to be enhanced to enable different materials of boards to be part of the overall fence structure.

SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

The aforementioned aspects and other objectives can now be achieved as described herein.

In an embodiment, a system includes a post configured at an initial position. The system also includes a plurality of ribs configured within an inner channel of the post. A front set of ribs are positioned at a front portion of the inner channel. A back set of ribs are positioned at a back portion of the inner channel behind the front set of ribs. In the system, the back set of ribs are configured to receive a different set of boards than the front set of ribs. The system also includes the set of boards that are positioned within the back set of ribs within the inner channel of the post.

In the system, the back set of ribs are configured to receive the set of boards consisting of vinyl material.

In the system, the post is configured as an end post.

In an embodiment, a system includes a first end post configured at an initial position. The system also includes a back set of ribs positioned within an inner channel of the first end post. A back set of ribs are positioned behind a front set of ribs within the inner channel. The back set of ribs are configured to receive a set of boards. The set of boards extend past the front set of ribs positioned in front of the back set of ribs within the inner channel and onto the back set of ribs. The system also includes a second end post positioned to receive another end of the set of boards that are positioned within the first end post.

In the system, the second end post includes a back set of ribs within an inner channel within the second end post.

In the system, the back set of ribs are configured to receive the set of boards made of vinyl materials.

In an embodiment, a method includes configuring a post at an initial position. The method also includes positioning a plurality of ribs within an inner channel of the post. A front set of ribs are positioned at a front portion of the inner channel. A back set of ribs are positioned at a back portion of the inner channel behind the front set of ribs. The back set of ribs are configured to receive a different set of boards than the front set of ribs. The method also includes configuring the set of boards within the back set of ribs within the inner channel of the post.

The method also includes positioning another back set of ribs to receive another end of the set of boards.

The method also includes positioning another post directly opposite to the first post to receive the set of boards.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1A:
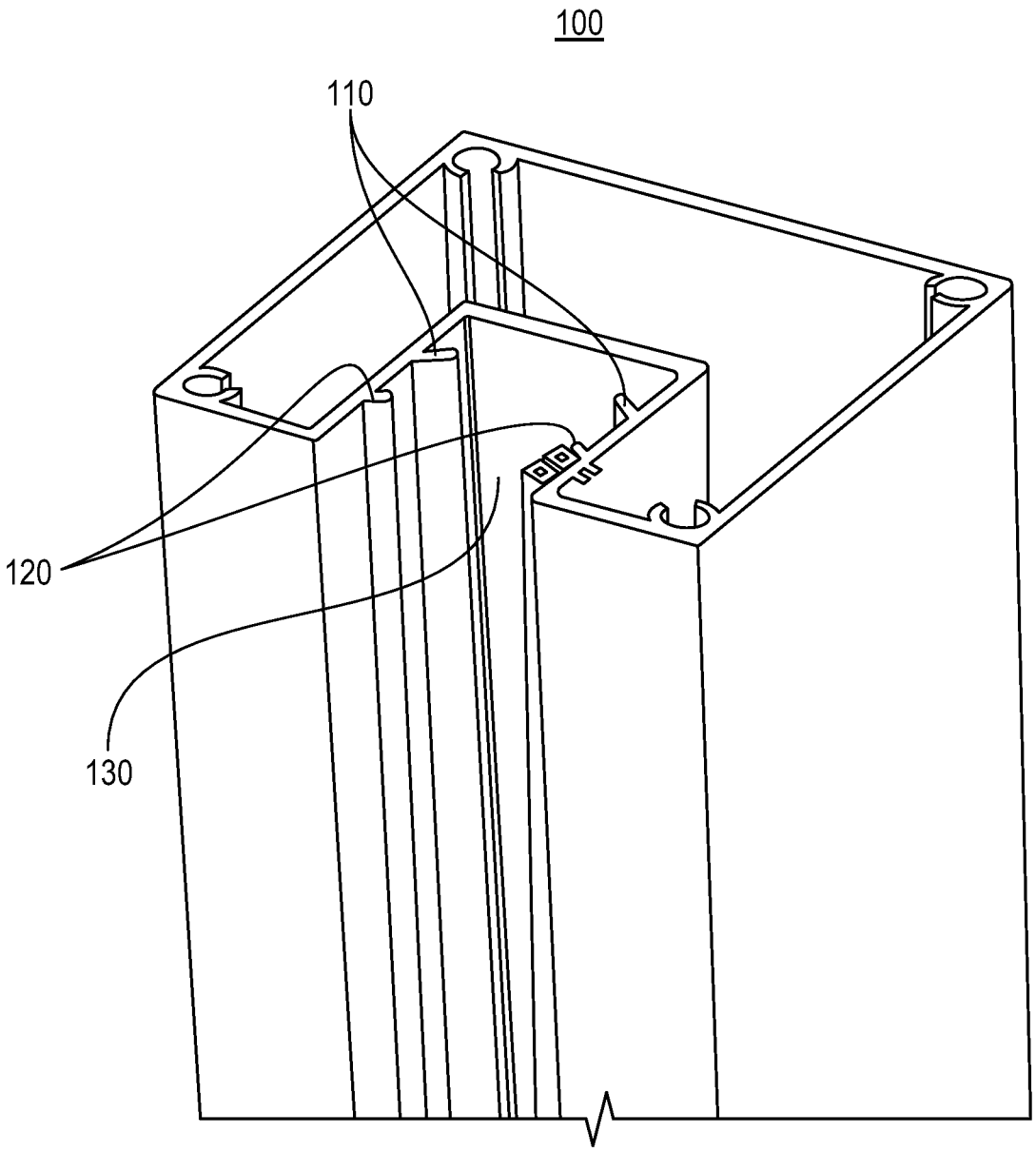
FIG. 1A illustrates an end post in accordance with an embodiment of the invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

A fence structure can have an enhanced aesthetic appeal while retaining structural integrity throughout the fence structure. In other words, the aesthetic appeal of the fence structure can be enhanced without reducing the structural support required for the boards to remain secured within the fence structure Within the fence structure, a variety of posts can be used to support the set of boards. In one or more embodiments, line posts, corner posts, or end posts can be used within the fence structure to receive the set of boards. Accordingly, in an embodiment, end posts can be utilized to receive the set of boards within the fence structure.

In each end posts are an inner channel. Within the inner channel are a front set of ribs and a back set of ribs. The front set of ribs are configured to typically receive wooden boards. The front set of ribs cannot receive vinyl boards. Nevertheless, in contrast, the back set of ribs within each end post are configured to receive vinyl boards.

Once the end posts are secured within the fence structure, a bottom rail will be positioned between each end post within the fence structure. After the bottom rail is positioned, the vinyl boards can be positioned between each end post. The vinyl boards will be positioned past the front set of ribs and onto the back set of ribs. As such, the back set of ribs enable the vinyl boards to be placed within each end point.

In various embodiments, the vinyl boards can also extend past the back set of ribs and onto the back end of the end post. Nevertheless, the back set of ribs enable the vinyl boards to be placed within each end post.

After, the vinyl boards have been placed within each end post, the top rail of the fence system can be placed in between each end post. After the top rail is positioned above the vinyl boards, screws within and/or around each end post can then be tightened to secure the top rail in position over the vinyl boards.

Overall, vinyl boards within the fence system will significantly add to the aesthetic appeal of the fence system. The vinyl boards will structurally be more appealing than traditional wooden boards. Further, the vinyl boards will be structurally supported by the end posts, top rail, and bottom rail within the fence system. Moreover, in various embodiments, corner posts and line posts can also provide the structural support for the vinyl boards. In any embodiment, the vinyl boards will structurally enhance the fence system without comprising any structural integrity within the fence system.

Figure 1B:
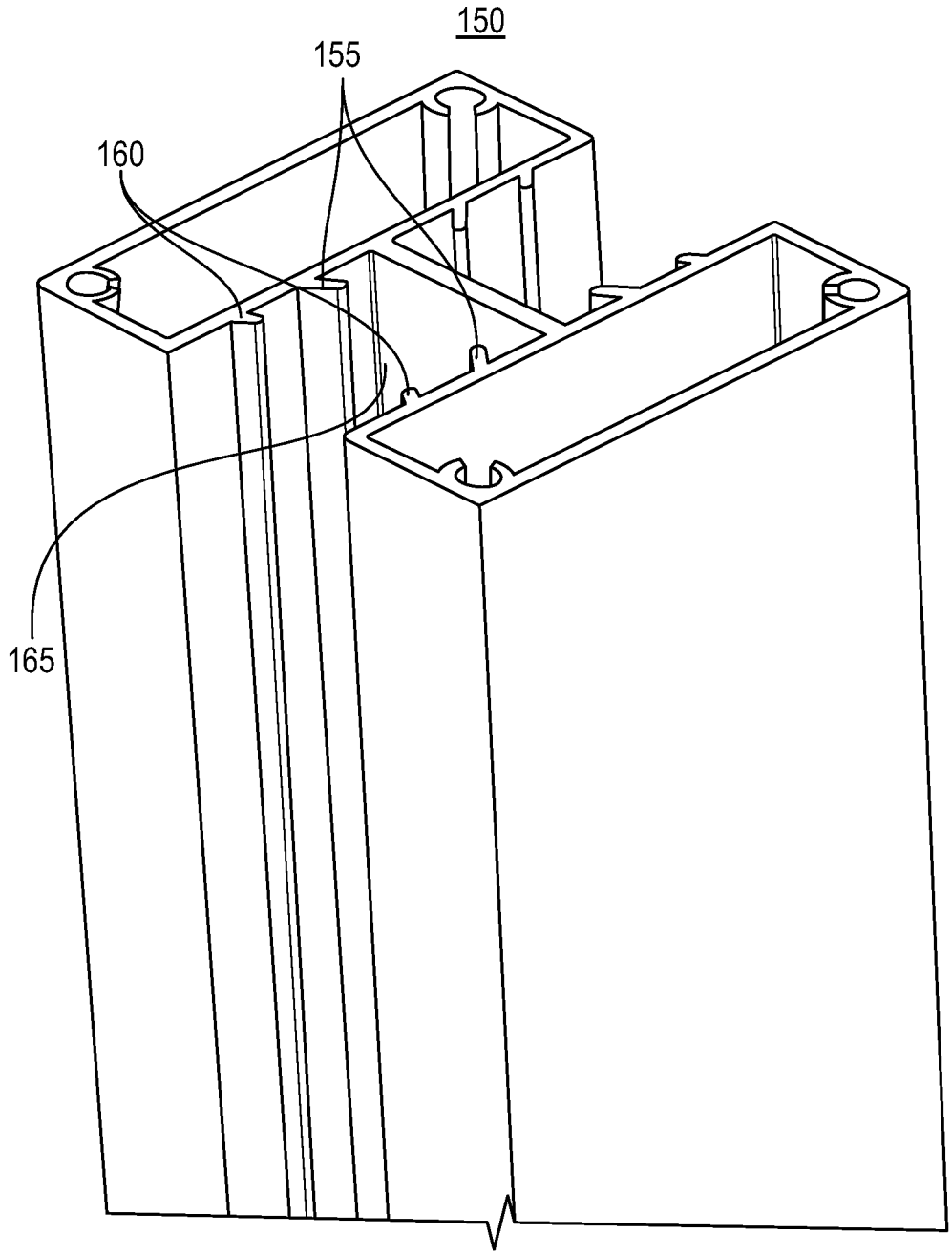
FIG. 1B illustrates a line post in accordance with an embodiment of the invention.
Figure 1C:
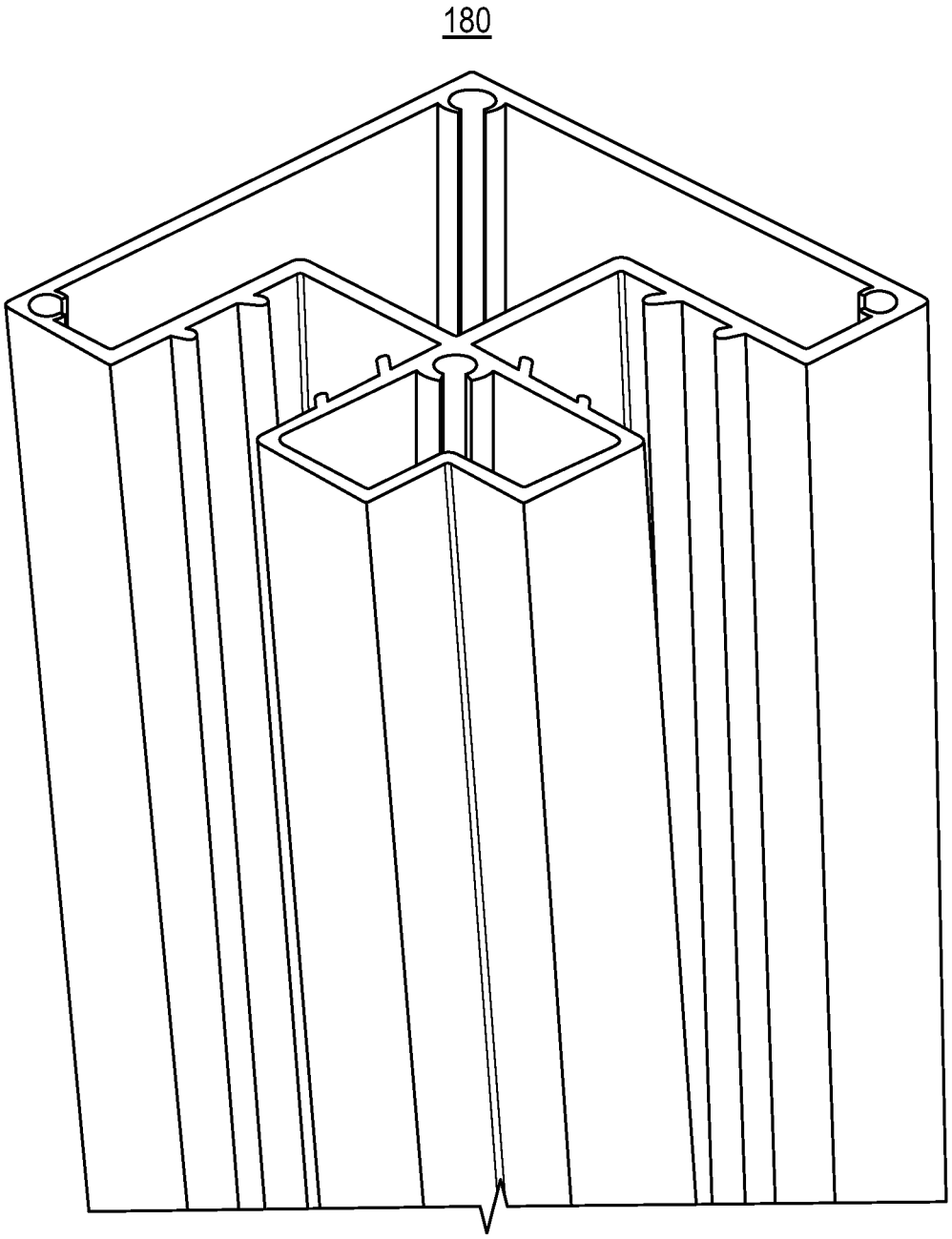
FIG. 1C illustrates a corner post in accordance with an embodiment of the invention.

FIGS. 1A-C illustrate different posts that can be used to enable different boards made up of different materials to be received within the posts. In various embodiments, all three types of posts can be used. As such, a line post, corner post, or end post can be used in various embodiments.

Referring to FIG. 1A, an end post 100 is illustrated. The end post 100 illustrates a front set of ribs 120 and a back set of ribs 110. The front set of ribs 120 and back set of ribs 110 are positioned within an inner channel 130 of the end post 100. The back set of ribs 110 are configured to receive boards made up of different materials than the front set of ribs 120. The back set of ribs 110 are able to receive vinyl boards instead of just wooden boards like the front set of ribs 120. In other words, vinyl boards can be positioned horizontally within the end post 100 and onto the back set of ribs 110. In contrast, the front set of ribs 120 cannot receive vinyl boards. The front set of ribs 120 are limited to receiving wooden boards. As such, users that want to place wooden boards within the end post 100 have to configure the wooden boards onto the front set of ribs 120. However, should the users want to place a vinyl set of boards, the vinyl set of boards will then be configured onto the back set of ribs 110. The back set of ribs 110 thereby enable vinyl boards to also be placed within the end post 100.

In FIG. 1B, a line post 150 is shown. The line post 150 also includes a back set of ribs 155 and a front set of ribs 165 that are positioned within an inner channel 160. The inner channel 160 can receive a set of boards. The front set of ribs 165 will be limited to receiving a wooden set of boards. However, the back set of ribs 155 will enable a vinyl set of boards to be positioned within the inner channel 160 of the line post 150. The other side of the line post 150 also includes a front set of ribs and a back set of ribs within an inner channel. Moreover, the back set of ribs in the other side of the line post 150 will also enable a vinyl set of boards to be placed within the inner channel on the other side of the line post 150.

Referring to FIG. 1C, a corner post 180 is shown. The corner post 180 can have multiple inner channels. Each of the inner channels will each include a front set of ribs at a front portion of each inner channel and a back set of ribs at a back portion of each inner channel. The back set of ribs will enable vinyl boards to be received within the corner post 180. The vinyl boards will extend past the front set of ribs and onto the back set of ribs within the corner post.

In FIGS. 1A-C, the back set of ribs 110, 155, etc. that are illustrated enable vinyl boards to be placed and configured securely within either the end post 100, line post 150, or corner post 180. The back set of ribs 110, 155, etc. allow various vinyl boards to be positioned within either the end post 100, line post 150, and corner post 180 as part of an overall fence structure. As a result, the overall fence structure or system can be aesthetically enhanced by vinyl boards will still be structurally supported by the end posts 100, line posts 150, or corner posts 180.

Figure 2A:
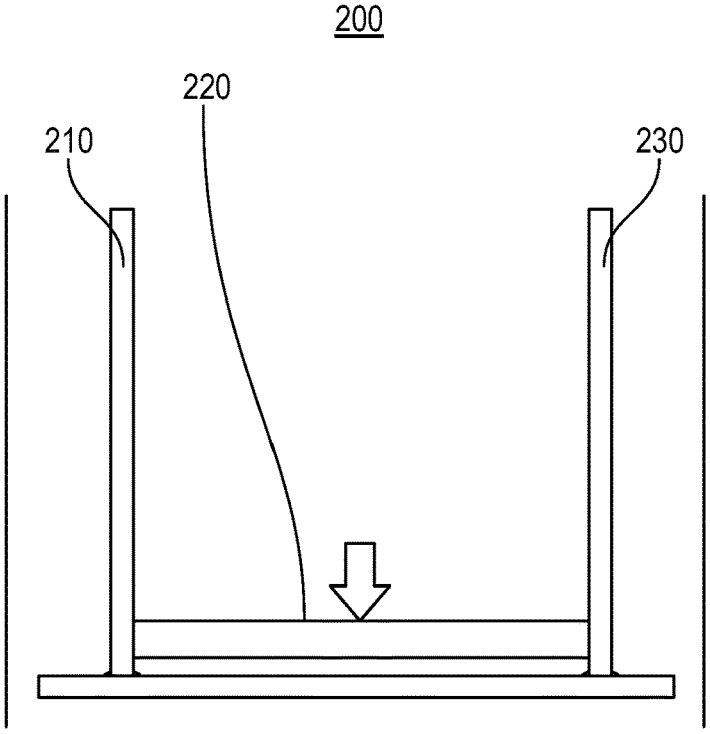
FIG. 2A depicts a view of the end post according to an embodiment of the invention.

Referring to FIG. 2A, a fence structure 200 is illustrated. The fence structure 200 will include a first end post 210 and a second end post 230. The first end post 210 and second end post 230 will each include a front set of ribs and a back set of ribs that are configured within an inner channel of the first end post 210 and second end post 230. The front set of ribs will limited to receiving wooden boards. However, the back set of ribs within the first end post 210 and second end post 230 can receive a vinyl set of boards. A bottom rail 220 will be placed in between the first end post 210 and the second end post 230. After the bottom rail 220 is positioned between the first end post 210 and the second end post 230, the vinyl set of boards can then be positioned within the first end post 210 and the second end post 230. The bottom rail 220 will provide structural support for the vinyl boards positioned within the first end post 210 and second end post 230.

Figure 2B:
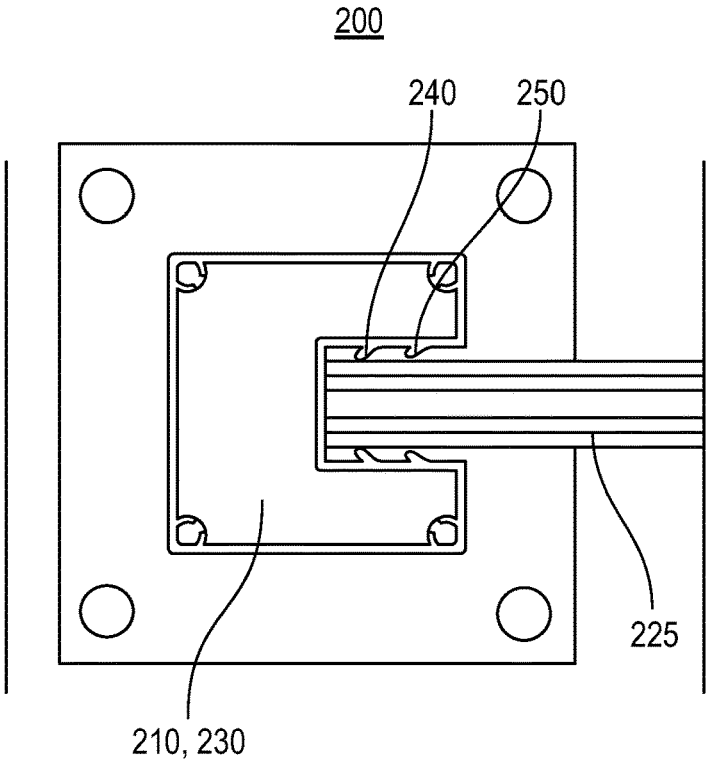
FIG. 2B illustrates a top view of the end post according to an embodiment of the invention.

In FIG. 2B, a top view of either the first end post 210 or second end post 230 is shown. Within the first or second end post 210, 230, a vinyl set of boards 225 are positioned. The vinyl set of boards 225 are positioned over the bottom rail 220. The vinyl set of boards 225 are positioned past the front set of ribs 250 and the back set of ribs 240 which will be positioned in both the first end post 210 and second end post 230. The back set of ribs 240 enable the vinyl boards 225 to be placed within the back set of ribs 240 in the inner channel of the first end post 210 and second end post 230. The vinyl set of boards 225 extend past both the front set of ribs 250 and the back set of ribs 240. The back set of ribs 240 enable the vinyl boards 225 to be positioned with both the first end post 210 and second end post 230. Moreover, the back set of ribs 240 enable the vinyl set of boards 225 to be secured within both the first end post 210 and second end post 230. The first end post 210 and second end post 230 will also provide structural support for the vinyl boards 225 as well.

Figure 3A:
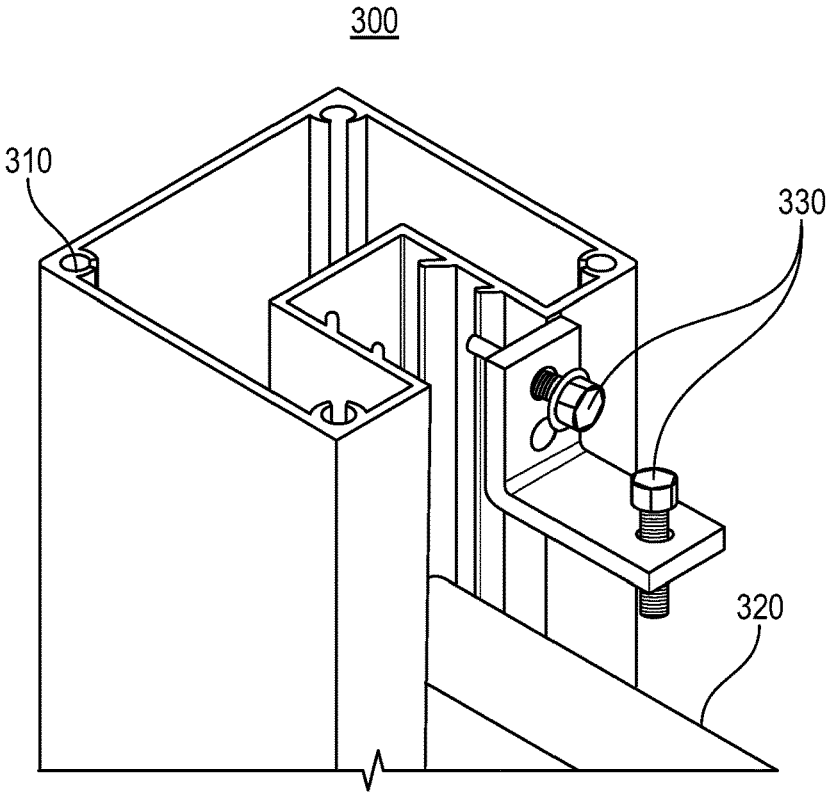
FIG. 3A depicts a view of the end post in accordance with an embodiment of the invention.

Referring FIG. 3A, once the vinyl boards are configured within the first end post and the second end post, the top rail can be positioned within the fence structure in between the first end post and the second end post. A plurality of screws can enable the top rail to be secured within the fence structure over the vinyl boards and bottom rail.

In FIG. 3A, the fence system 300 is shown. The first end post 310 is shown with the vinyl set of boards configured within the first end post 310. The top rail 320 can then be positioned over the final set of boards. Screws 330 can be used to secure the top rail 320 over the vinyl boards. As such, securing the screws 330 in their final positions will secure the top rail 320 over the vinyl boards. The screws 330 can be secured within the first end post 310 and also the second end post to enable the top rail 320 to be secured within the fence system 300.

Figure 3B:
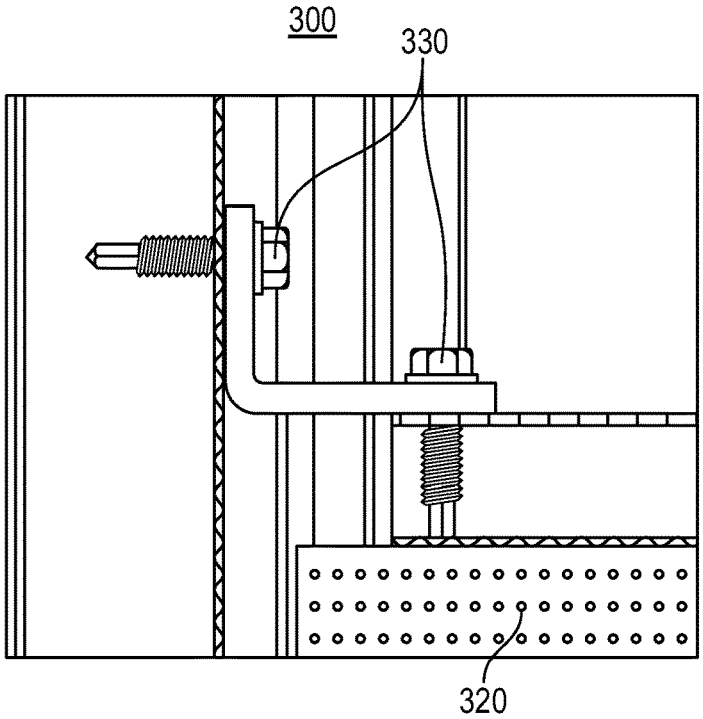
FIG. 3B illustrates another view of the end post in accordance with an embodiment of the invention.

Referring to FIG. 3B, another view of the fence system 300 is shown. The top rail 320 is secured over the vinyl boards within the first end post. The second end post can also have the top rail 320 secured within an inner channel of the second end post. The screws 330 will be screwed tightly in their final positions. When the screws 330 are positioned tightly within the first and second end post, the top rail 320 will then be secured over the vinyl boards and also within the inner channel of the first end post and second end post. Accordingly, when the top rail 320, vinyl boards, and bottom rail are secured within the first end post and second end post, the fence structure 300 can be complete. When secured, the top rail 320 will provide additional structural support to the vinyl boards positioned within the fence system 300.

Figure 4:
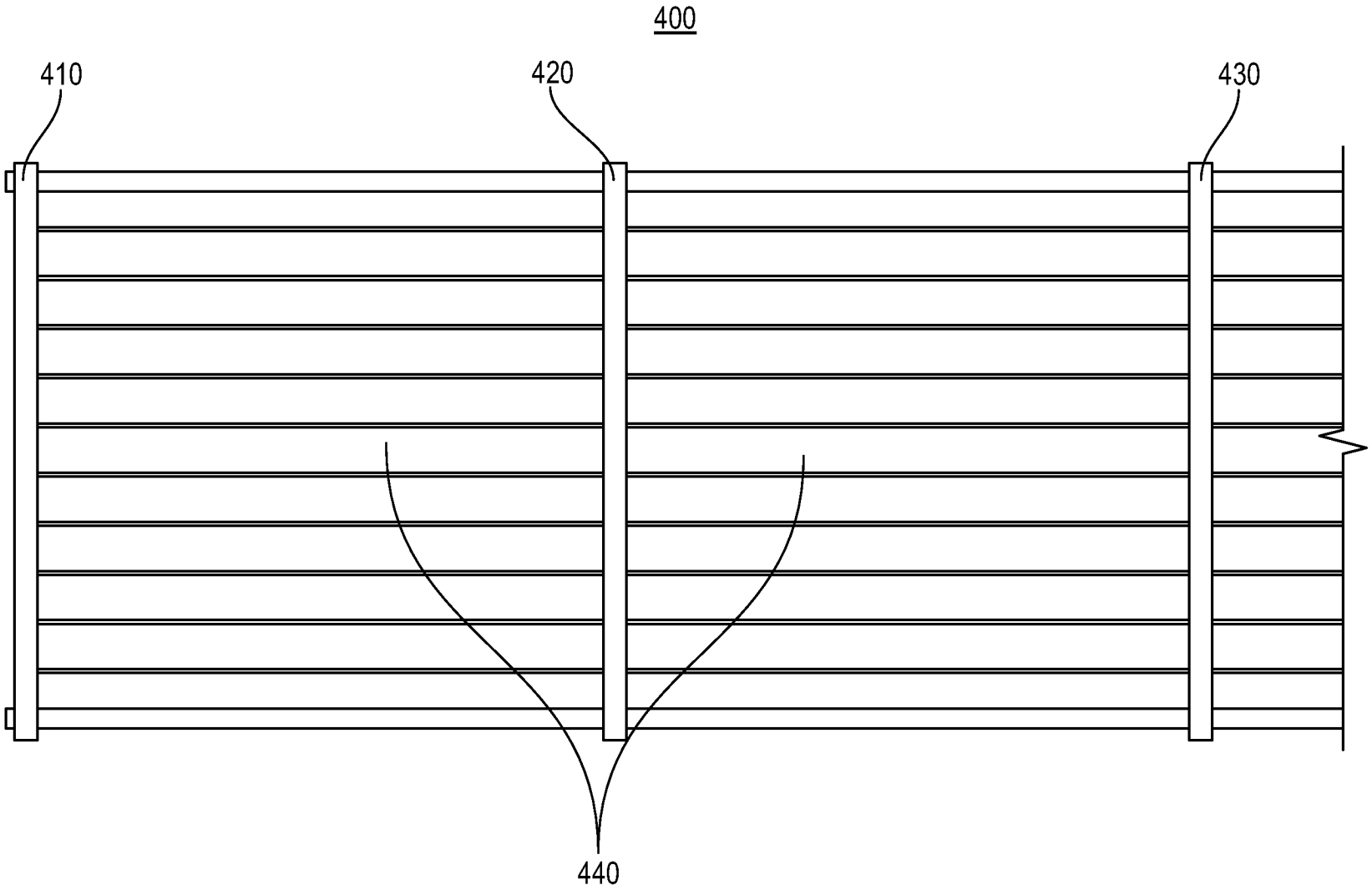
FIG. 4 depicts end posts and a vinyl fence in accordance with an embodiment of the invention.

Referring to FIG. 4, a fence system/structure 400 is shown with vinyl boards 440 positioned horizontally with end posts 410, 420, 430. The vinyl boards will structurally enhance the fence system 400 and also have structural support from the end posts 410, 420, 430.

In FIG. 4, the end posts 410, 420, 430 each include a front set of ribs and a back set of ribs. The back set of ribs within each end post 410, 420, 430 enable the vinyl boards 440 to be positioned within the end posts 410, 420, 430. After the bottom rail is positioned, the vinyl boards 440 can be positioned within the end posts 410, 420, 430. The vinyl boards will be positioned past the front set of ribs within the end posts 410, 420, 430 and onto the back set of ribs within the end posts 410, 420, 430. Further, the vinyl boards 440 can also extend past the back set of ribs within the end posts 410, 420, 430 and onto a back end of the end posts 410, 420, 430. The back set of ribs within each of the end posts 410, 420, 430 enable the vinyl boards 440 to be placed within an inner channel of the end posts 410, 420, 430. A top rail will also enable the vinyl boards to remain secured within the end posts 410, 420, 430 respectively.

Referring to FIG. 4, after the vinyl boards 440 are positioned securely within an inner channel of the end posts 410, 420, 430, a top rail can then be positioned over the vinyl boards 440. Screws within the end posts 410, 420, 430 can be secured to enable the top rail to be securely positioned over the vinyl boards 440. The secured top rail and bottom rail within the fence system 400 will allow the vinyl boards 440 to remain secured within each of the end posts 410, 420, 430.

In FIG. 4, the vinyl boards 440 can be positioned within the end posts 410, 420, 430 and above and underneath the top rail and bottom rail of the fence system 400 respectively. The back set of ribs within each of the end posts 410, 420, 430 enable the vinyl boards 440 to be positioned within the end posts 410, 420, 430. The structure of the back set of ribs enables the vinyl boards 440 to be used within the end posts 410, 420, 430 as opposed to just wooden boards with the front set of ribs. Accordingly, the back set of ribs allows the vinyl boards 440 to be positioned within as opposed to the front set of ribs within the end posts 410, 420, 430 that are limited to receiving wooden boards. As such, due to the back set of ribs within the end posts 410, 420, 430, a fence system 400 made up of different materials can be part of the same interconnected fence structure. The vinyl boards 400 will enhance the aesthetic appeal of the fence system 400 and will be firmly supported by the by the sturdy structures of the end posts 410, 420, 430 and also the top and bottom rail.

Figure 5:
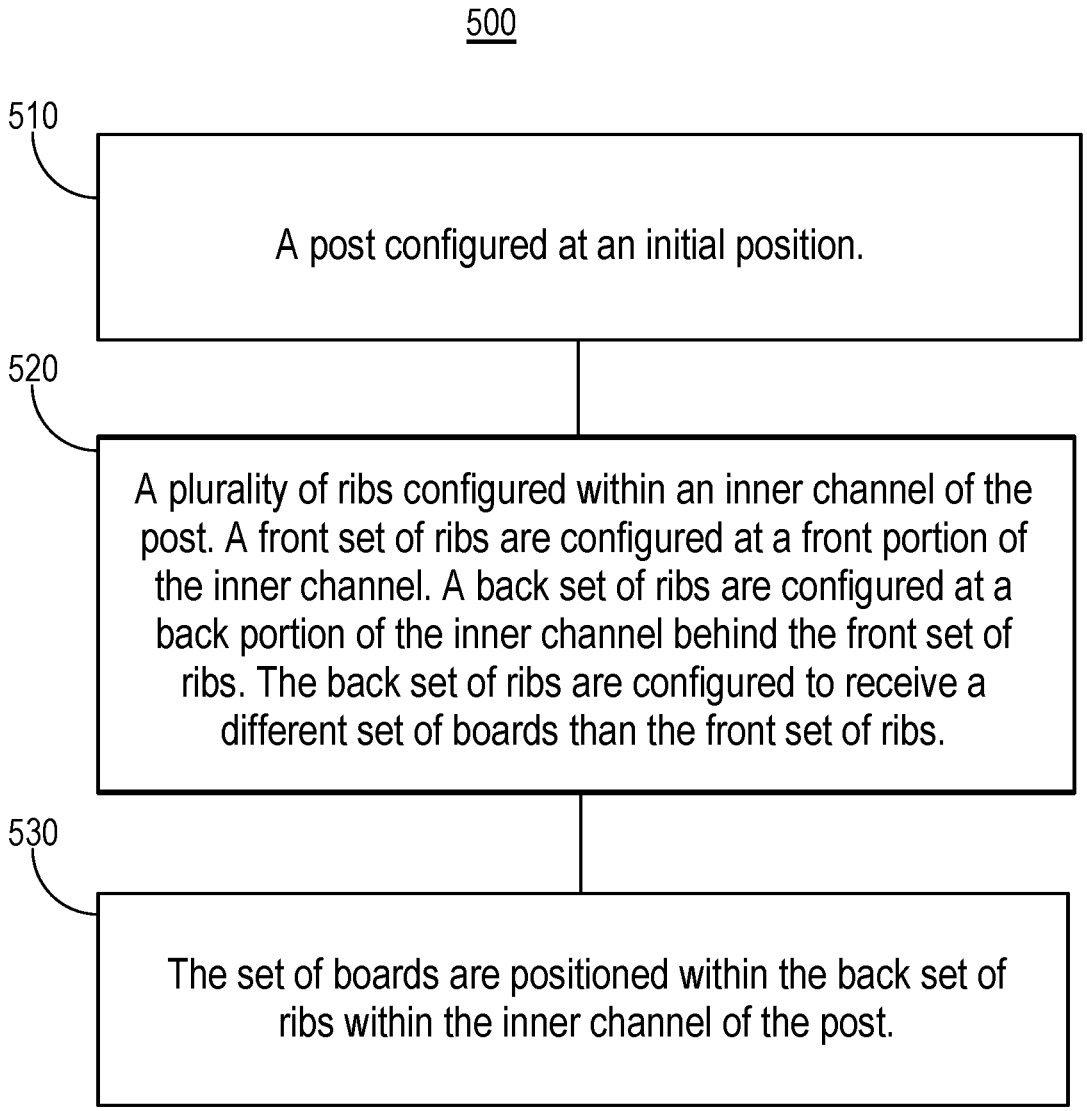
FIG. 5 illustrates a flow chart in accordance with an embodiment of the invention.

Referring to FIG. 5, a method 500 is shown of positioning a mixed material fence system. Moreover, the method includes securing vinyl boards within the fence system. The vinyl boards will be structurally supported by the end posts and also by the top rail and bottom rail within the fence system. In addition, the vinyl boards will enhance the aesthetic appeal of the fence structure.

In FIG. 5, at step 510, an end post is configured at an initial position. In various embodiments, an end post, line post, or corner post can be used. In an embodiment, the fence system, the user may prefer to use an end post. In other embodiments, the user can desire to use a line post or a corner posts. Accordingly, in an embodiment, the user can decide to use an end post. As such, the end post will include a front set of ribs and a back set of ribs. The front set of ribs will be limited to receiving wooden boards. However, the back set of ribs will enable vinyl boards to be placed within the end post. The back set of ribs can be positioned within an inner channel within the end post.

Referring to FIG. 5, at step 520, a plurality of ribs are configured within an inner channel of the end posts. The plurality of ribs include a front set of ribs and a back set of ribs. A front set of ribs are configured at a front portion of the inner channel. Behind the front set of ribs are the back set of ribs. The back set of ribs are configured at a back portion of the inner channel. Moreover, the back set of ribs are configured to receive a different material of boards than the front set of ribs. In particular, the front set of ribs are limited to receiving wooden boards. However, the back set of ribs can receive vinyl boards. Accordingly, the vinyl boards will be positioned onto the back set of ribs within the inner channel of both end posts.

In FIG. 5, at step 530, the set of vinyl boards are positioned within the back set of ribs within the inner channel for each end post within the fence structure. The vinyl boards will be positioned horizontally within the back set of ribs. Moreover, the vinyl boards will also extend past the front set of ribs and also the back set of ribs onto a back end of each end post. Nevertheless, the back set of ribs within each end post enable the vinyl boards to be positioned within each end post of the fence structure. As a result, the vinyl boards are structurally supported by the end posts, and also structurally enhance the fence structure.

Advantages/Summary

In summary, the vinyl boards can be part of a mixed material fence system. The fence system in one or more embodiments can use line posts, corner posts, or end posts. In various embodiments, the user can device to use either line posts, corner posts, or end posts. For ease of explanation, end posts are described. Nevertheless, the line posts an corner posts can also receive the vinyl boards described above.

In each end post are a front set of ribs and a back set of ribs. The front set of ribs are at a front portion of the end posts while the back set of ribs are at a back portion of the end posts. The front set of ribs are configured to receive a wooden set of boards. However, the front set of ribs cannot receive materials such as vinyl boards. Nevertheless, the back set of ribs can receive the vinyl set of boards.

A bottom rail can be positioned in between each end post of the fence structure. The material of the bottom rail can be sturdier and be of a different material than the vinyl boards. After the bottom rail is positioned between each end post, the vinyl boards can be placed in their respective positions. The vinyl boards can be placed past the front set of ribs and onto the back set of ribs. In one or more embodiments, the vinyl boards can then be placed past the back set of ribs and onto the back end of each end post.

After the vinyl boards have been positioned within the fence structure, the top rail can be positioned between each end post. The top rail will be positioned over the vinyl boards. The top rail can be positioned within the inner channel of each end post. A plurality of screws at a top portion of the fence structure can secure the top rail over the vinyl boards within the fence structure. The top rail will provide structural support for the vinyl boards as well.

The vinyl boards will be structurally supported by the top rail, end posts, and bottom rail. The vinyl boards will be of a different material than the top rail, end posts, and bottom rail within the fence structure. The vinyl boards will add to the aesthetic appeal and structural enhancement of the fence structure without compromising the structural stability. The back set of ribs within each end post within the fence structure enables the vinyl boards to be positioned within each end post. Accordingly, the back set of ribs enables the fence structure to have an enhanced aesthetic appeal with the vinyl boards while retaining the structural support from the top rail, end posts, and bottom rail within the fence structure.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments.

The invention claimed is:

1. A system comprising:

a post configured at an initial position;

a plurality of ribs integrally formed with the inner channel, wherein a front set of ribs project a first distance from an inner surface of the inner channel and are positioned at a front portion of the inner channel, and a back set of ribs project a second distance different than the first distance from the inner surface and are positioned at a back portion of the inner channel behind the front set of ribs, wherein the back set of ribs are configured to receive a plurality of boards; and the plurality of boards are positioned within the back set of ribs within the inner channel of the post.

2. The system of claim 1, wherein the back set of ribs are configured to receive the plurality of boards consisting of vinyl material.

3. The system of claim 1, wherein the post is configured as an end post.

4. The system of claim 1, wherein another post is configured at an opposite end of the plurality of boards.

5. The system of claim 1, wherein a top rail is configured over the plurality of boards positioned within the back set of ribs.

6. The system of claim 1, wherein the plurality of boards are positioned horizontally within the back set of ribs.

7. The system of claim 1, wherein the plurality of boards extend horizontally past the back set of ribs.

8. A system comprising:

a first end post configured an initial position;

a back set of ribs integrally formed with an inner channel of the first end post and projecting a first distance from an inner surface of the inner channel, wherein the back set of ribs are positioned behind a front set of ribs within the inner channel, wherein the front set of ribs project a second distance different than the first distance from the inner surface of the inner channel, and wherein the back set of ribs are configured to receive a plurality of boards, wherein the plurality of boards extend past the front set of ribs positioned in front of the back set of ribs within the inner channel and onto the back set of ribs; and a second end post positioned to receive another end of the plurality of boards that are positioned within the first end post.

9. The system of claim 8, wherein the second end post includes a back set of ribs positioned within an inner channel within the second end post.

10. The system of claim 8, wherein the back set of ribs are configured to receive the plurality of boards made of vinyl materials.

11. The system of claim 8, further comprising:

a top rail positioned horizontally over the plurality of boards.

12. The system of claim 8, further comprising:

a back set of ribs within the second end post that receives the plurality of boards.

13. The system of claim 8, wherein a back end of the first end post is in contact with the plurality of boards.

14. The system of claim 8, further comprising:

a top rail that is positioned in contact with a back end of the first end post and a back end of the second end post.

15. A method comprising:

configuring a post at an initial position;

positioning a plurality of ribs integrally formed with the inner channel configured within an inner channel of the post, wherein a front set of ribs project a first distance from an inner surface of the inner channel and are positioned at a front portion of the inner channel, and a back set of ribs project a second distance different than the first distance from the inner surface and are positioned at a back portion of the inner channel behind the front set of ribs, wherein the back set of ribs protrude from an inner surface of the inner channel and are configured to receive a plurality of boards; and configuring the plurality of boards within the back set of ribs within the inner channel of the post.

16. The method of claim 15, further comprising:

positioning a second post comprising a second back set of ribs within an inner channel of the second post to receive another end of the plurality of boards.

17. The method of claim 15, further comprising:

positioning another post directly opposite to the first post to receive the plurality of boards.

18. The method of claim 15, further comprising:

placing the plurality of boards in contact with a back end of the post.

19. The method of claim 15, further comprising:

configuring a top rail onto a back end of the post.

20. The method of claim 15, further comprising:

extending the plurality of boards past the back set of ribs toward a back end of the post.

* * * * *